US008141866B2

(12) United States Patent
Okawa et al.

(10) Patent No.: US 8,141,866 B2
(45) Date of Patent: Mar. 27, 2012

(54) SHEET MATERIAL FEEDING DEVICE AND RECORDING APPARATUS

(75) Inventors: Soshi Okawa, Shiojiri (JP); Akira Nemura, Matsumoto (JP); Hiroyuki Sugimoto, Matsumoto (JP); Sho Aruga, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/011,699

(22) Filed: Jan. 21, 2011

(65) Prior Publication Data

US 2011/0180986 A1 Jul. 28, 2011

(30) Foreign Application Priority Data

Jan. 25, 2010 (JP) ..... 2010-012985

(51) Int. Cl.
*B65H 3/52* (2006.01)
*B65H 3/34* (2006.01)

(52) U.S. Cl. ..... 271/121; 271/124; 271/167

(58) Field of Classification Search ..... 271/121, 271/124, 167

See application file for complete search history.

(56) References Cited

U.S. PATENT DOCUMENTS

| | | | | |
|---|---|---|---|---|
| 5,895,040 | A | 4/1999 | Oleksa et al. | |
| 6,880,821 | B2 * | 4/2005 | Park | 271/121 |
| 2003/0132570 | A1 * | 7/2003 | Park | 271/167 |
| 2004/0032077 | A1 * | 2/2004 | Oh et al. | 271/121 |
| 2007/0132172 | A1 * | 6/2007 | Mo | 271/121 |
| 2007/0222139 | A1 * | 9/2007 | Hotani | 271/121 |
| 2009/0026693 | A1 * | 1/2009 | Lim | 271/121 |

FOREIGN PATENT DOCUMENTS

JP 11-011719 1/1999

* cited by examiner

*Primary Examiner* — David H Bollinger
(74) *Attorney, Agent, or Firm* — Workman Nydegger

(57) ABSTRACT

A paper feeding device having a paper cassette configured to support a plurality of the papers in a stacked manner, a separating bevel having an inclined plane inclined at a predetermined angle with respect to a supporting surface of the paper cassette and configured to separate the paper coming into abutment with the inclined plane, a pickup roller configured to feed the paper toward the separating bevel by coming into contact with the topmost paper from among the papers supported by the paper cassette and being rotated thereon, and a space forming unit configured to form a space S for letting part of the paper to escape in the feeding direction on part of the inclined plane in the area opposing the pickup roller in the feeding direction is employed.

9 Claims, 13 Drawing Sheets

PAPER REACTION FORCE ACCORDING TO COLUMN NUMBER

FIG. 5

| PAPER TYPE | UGPP (PHOTO PAPER) | XP (NORMAL PAPER) |
|---|---|---|
| PAPER SIZE | A4 | A4 |
| PAPER THICKNESS | 0.3 mm | 0.1 mm |
| PAPER WIDTH | 210.0 mm | 210.0 mm |
| YOUNG'S MODULUS E | 359.8 $kgf/mm^2$ | 147.3 $kgf/mm^2$ |
| GEOMETRICAL MOMENT OF INERTIA I | 0.473 $mm^4$ | 0.018 $mm^4$ |
| $E*I$ | 170.0055 | 2.57775 |

SHEET MATERIAL FEEDING DEVICE AND RECORDING APPARATUS

The entire disclosure of Japanese Patent Application No. 2010-012985, filed Jan. 25, 2010 is expressly incorporated by reference herein.

BACKGROUND

1. Technical Fields

The present invention relates to a sheet material feeding device and a recording apparatus.

2. Related art

As a recording apparatus configured to record characters or images on various sheet materials such as paper, cloth, film, for example, a copying machine, a printer, and a facsimile are exemplified. The recording apparatus of this type includes a sheet material feeding device configured to separate a single sheet material from a stacking portion (supporting portion) that supports a plurality of the sheet materials in a stacked manner and feed the separated material to a recording unit configured to perform a recording process. The sheet material feeding device includes a separating unit having a separating bevel inclined at a predetermined angle with respect to a sheet material supporting surface and configured to separate the sheet materials fed toward the separating bevel by a pickup roller one by one separately by applying a load (including a reaction force and a frictional force) in the direction opposite from a feeding direction against the sheet materials which come into abutment with an inclined plane of the separating bevel in order to prevent double feed (multiple feed) which feeds two or more sheet materials simultaneously as described in JP-A-11-11719.

In recent years, there are a variety of types (material quality, size, thickness, etc.) of the sheet materials which is available for a recording process. Therefore, a mode to store a plurality of types of the sheet materials in a stack portion and separate the plurality of types of sheet materials using a common separating unit is employed. However, the sheet materials of different types are different in rigidity. Therefore, the separating bevel in the related art has a problem such that application of loads suitable for the separation of the sheet materials according to their rigidities is difficult.

In general, in order to avoid the double feed of papers having low rigidity such as normal papers, it is required to make the angle of the inclined plane steeper to increase the load applied at the separating bevel. However, in the case of papers having high rigidities such as photo papers or post cards, when they come into abutment at the steeper angle, the load (reaction force) acts strongly on these papers and, consequently, slippage may occur between a pickup roller and the papers and hence a phenomenon such that feeding of paper is disabled, so-called a non-feed phenomenon may easily be caused. In other words, since the photo paper for example has high rigidity, the photo paper hardly achieves buckling (flexure, bending) deformation at the separating bevel and hence it is difficult to be fed along the inclined plane.

In contrast, there is a method of reducing the angle of inclination of the inclined plane to reduce the load of the separation bevel in order to separate and feed the papers with high rigidity such as the photo paper adequately. In this method, however, the load which acts on the normal paper is in turn reduced, and hence a required load for the separation cannot be obtained at the separating bevel, which may result in the double feed. Alternatively, there is a method of allowing the paper to be deformed easily by increasing the distance between the separating bevel and the pickup roller in order to separate and feed the papers with high rigidity such as the photo paper adequately. In this method, however, the papers having low rigidity are easily deformed as well, and hence a required load for the separation cannot be obtained at the separating bevel, which may result in the double feed. Both of these methods are suffered from the problem of upsizing of the apparatus.

SUMMARY

An advantage of some aspects of the invention is to provide a sheet material feeding device and a recording apparatus which realizes a highly reliable separation of sheet materials having different rigidities and achieve downsizing of the apparatus.

After having devoted ourselves to make repeated experiments, the inventors found that a load (reaction force) generated when the sheet material comes into abutment with an inclined plane of a separating bevel varies with the rigidity of the sheet material even when a feeding force (rotary drive force) of a pickup roller, and that the load (reaction force) generated when the sheet material comes into abutment with the inclined plane of the separating bevel is distributed according to the position of the pickup roller, and hence has come up with the invention.

In other word, according to an aspect of the invention, there is provided a sheet material feeding device including a supporting unit that supports a plurality of sheet materials in a stacked manner, a separating bevel having an inclined plane inclined at a predetermined angle with respect to a supporting surface of the supporting unit and separates the sheet material coming into abutment with the inclined plane, a pickup roller that feeds the sheet material toward the separating bevel by coming into contact with the topmost sheet material from among the sheet materials supported by the supporting unit and being rotated thereon, and a space forming member that forms a space on part of the inclined plane in an area opposing the pickup roller in the feeding direction for letting part of the sheet material to escape in the feeding direction.

In this configuration, the space for letting the sheet material to escape in the feeding direction with respect to other inclined planes is formed in an area opposing the pickup roller where the load (reaction force) reaches its peak when the sheet material comes into abutment with the inclined plane of the separating bevel. Accordingly, the load (reaction force) in the area where the load reaches its peak may be reduced. Therefore, a non-feed phenomenon which may occur when the sheet material having high rigidity is fed is restrained.

When the area opposing the pickup roller is depressed in the feeding direction, the distance in this area for deformation of the sheet material having high rigidity can be elongated. Therefore, the load can be reduced for example by increasing the bending radius of the sheet material. When the part of the sheet material escapes into the space when the sheet material comes into abutment with the inclined plane of the separating bevel, the sheet material is subjected to buckling deformation or waving deformation at a boundary between the space and the inclined plane, so that the sheet material having high rigidity can easily be deformed from the deformed portion as a starting point, and feeding along the inclined plane is facilitated. Furthermore, since the load of the sheet material having high rigidity can be reduced by forming the space in part of the inclined plane, it is not necessary to take a long distance between the inclined plane and the pickup roller or to reduce the angle of the inclined plane as in the related art, so that downsizing of the apparatus is achieved.

Preferably, the width of the space in the same direction as the axis of the pickup roller is set on the basis of the width of the pickup roller in the axial direction.

In this configuration, the load distribution when the sheet material comes into abutment with the inclined plane of the separating bevel varies on the basis of the width of the pickup roller in the axial direction. Therefore, a load (reaction force) suitable for the sheet material can be applied by setting the width of the space on the basis of the width of the pickup roller in the axial direction.

Preferably, the width of the space in the same direction as the axis of the pickup roller is set on the basis of rigidity of the sheet material.

In this configuration, the load generated when the sheet material comes into abutment with the inclined plane of the separating bevel varies with the rigidity of the sheet material. Therefore, the load (reaction force) suitable for the sheet material can be applied by setting the width of the space on the basis of the rigidity of the sheet material.

When the space for letting part of the paper to escape is formed on the inclined plane of the separating bevel, the load applied to the sheet material having high rigidity can be reduced, but the load applied to the sheet material having low rigidity is slightly affected as well. Accordingly, in order to realize the highly reliable separation of the sheet material having different rigidities with higher reliability, the invention employs the following configuration.

In other words, preferably, the space forming unit includes a second separating bevel movable between a space forming position where the space is formed and a position of separation which forms a plane substantially flush with the inclined plane.

In this configuration, the second separating bevel movable between the space forming position and the position of separation is provided and, when the sheet material having high rigidity is fed, the load applied to the sheet material is reduced by positioning the second separating bevel in the space forming position. In contrast, when the sheet material having low rigidity is fed, the second separating bevel is positioned at the position of separation to be brought into abutment with the sheet material, so that reduction of the load is prevented. Therefore, the load to be applied to the sheet material having low rigidity is increased without affecting the sheet material having high rigidity, so that reliable separation with less probability of the double feed is realized.

Preferably, the second separating bevel is positioned at the position of separation when a reaction force generated when the fed sheet material and the inclined plane come into abutment with each other is smaller than a predetermined value set on the basis of the rigidity of the sheet material, and is positioned at the space forming position when the reaction force is larger than the predetermined value.

In this configuration, the second separating bevel can be moved between the space forming position and the position of separation according to the reaction force applied when the sheet material actually comes into abutment by defining a threshold value (predetermined value) for the movement of the second separating bevel on the basis of the reaction force generated when the sheet material comes into abutment with the inclined plane of the separating bevel. Since the reaction force generated when the sheet material comes into abutment with the inclined plane of the separating bevel varies with the rigidity of the sheet material, the second separating bevel can be moved to a suitable position according to the rigidity of the sheet material by setting the threshold value for the movement of the second separating bevel on the basis of the rigidity of the sheet material.

Preferably, an urging device that urges the second separating bevel toward the position of separation is provided and the second separating bevel moves against the urging force from the position of separation to the space forming position.

In this configuration, since the second separating bevel is urged toward the position of separation in the normal state, the load is small even though the sheet having low rigidity is fed, and hence separation is performed at the position of separation. However, when the sheet material having high rigidity is fed, the load is large, and hence the sheet material having high rigidity is pushed against the urging force and moved to the space forming position. Therefore, the space that reduces the load is formed at the space forming position.

Preferably, a third separating bevel provided on part of the inclined plane except for part where the space is formed and having a second inclined plane which demonstrates a higher frictional force than the inclined plane is provided, and the third separating bevel is provided so as to be movable between a second position of separation where the second inclined plane is positioned on the upstream side of the inclined plane in the feeding direction and a third position of separation where the inclined plane and the second inclined plane are substantially flush with each other.

In this configuration, with the provision of the third separating bevel movable between the second position of separation and the third position of separation, and having a high frictional force, when the sheet material having low rigidity is fed, the third separating bevel is positioned at the second position of separation, so that the load (frictional force) is increased by coming into abutment with the sheet material on the second separating bevel and hence the separating performance is improved. In contrast, when the sheet material having high rigidity is fed, the third separating bevel is positioned at the third position of separation, so that increase of the load applied to the sheet material on the third separating bevel is restrained. Therefore, the load to be applied to the sheet material having low rigidity is increased without affecting the sheet material having high rigidity, so that reliable separation with less probability of the double feed is realized.

Preferably, the third separating bevel is positioned at the second position of separation when the reaction force generated when the fed sheet material and the inclined plane come into abutment with each other is smaller than a predetermined value set on the basis of the rigidity of the sheet material, and is positioned at the third position of separation when the reaction force is larger than the predetermined value.

In this configuration, the third separating bevel can be moved between the second position of separation and the third position of separation according to the reaction force applied when the sheet material actually comes into abutment by defining a threshold value (predetermined value) for the movement of the third separating bevel on the basis of the reaction force generated when the sheet material comes into abutment with the inclined plane of the separating bevel. Since the reaction force generated when the sheet material comes into abutment with the inclined plane of the separating bevel varies with the rigidity of the sheet material, the third separating bevel can be moved to a suitable position according to the rigidity of the sheet material by setting the threshold value for the movement of the third separating bevel on the basis of the rigidity of the sheet material.

Preferably, a second urging device that urges the third separating bevel toward the second position of separation is provided, and the third separating bevel moves against the urging force from the second position of separation to the third position of separation.

In this configuration, since the second separating bevel is urged toward the second position of separation in the normal state, the load is small even though the sheet having low rigidity is fed, and hence separation is performed at the position of separation. However, when the sheet material having high rigidity is fed, the load is large, and hence the sheet material having high rigidity is pushed against the urging force and moved to the third position of separation, where increase in load is restrained.

Preferably, an abutment surface of the second inclined plane which comes into abutment with the sheet material when being fed is formed to have a larger angle than a predetermined angle of the inclined plane.

In this configuration, the angle of inclination of the second inclined plane is increased, so that the third separating bevel can demonstrate a high frictional force without providing a separate high frictional member or the like.

According to a second aspect of the invention, there is provided a recording apparatus including the sheet material feeding device as described above and a recording unit that performs a recording process on the sheet material fed by the sheet material feeding device.

In this configuration, since the highly reliable separation of the sheet materials having different rigidities is realized, defective feeding of the sheet material due to the paper jam caused by double feed or non-feed is avoided. In addition, the downsizing of the apparatus is achieved, so that the recording apparatus which allows space saving is obtained.

BRIEF DESCRIPTION OF THE DRAWINGS

The invention will be described with reference to the accompanying drawings, wherein like numbers reference like elements.

FIG. 5 is a table for describing the difference in paper rigidity between a specific paper (photo paper) and a normal paper.

DESCRIPTION OF EXEMPLARY EMBODIMENTS

Figure 1:
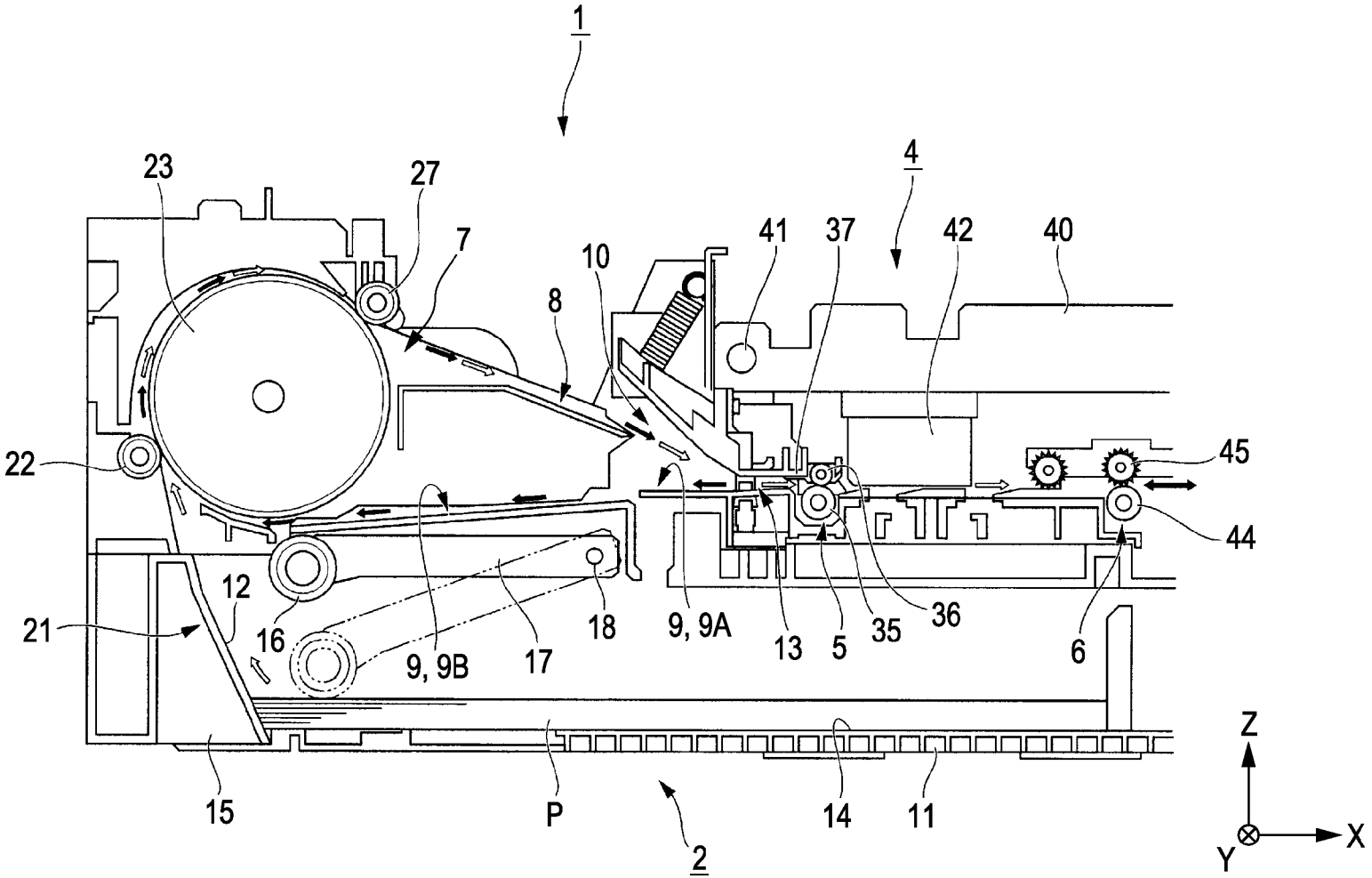
FIG. 1 is a cross-sectional side view showing a paper transporting route of a printer according to a first embodiment of the invention.

Referring now to the drawings, embodiments of a sheet material feeding device and a printing apparatus according to the invention will be described. In the respective drawings used for the description given below, scaling of the respective members is changed as needed to allow the respective members to be recognizable. In the embodiments, an ink jet printer (hereinafter, referred to as "printer") is exemplified as the recording apparatus according to the invention.

First Embodiment

FIG. 1 is a cross-sectional side view showing a paper transporting route of a printer 1 according to a first embodiment of the invention.

In the description given below, an XYZ orthogonal coordinate system is set as shown in FIG. 1, and a positional relationship of the respective members may be described while referring to the XYZ orthogonal coordinate system. A predetermined direction within a horizontal plane is defined as an X-axis direction, a direction orthogonal to the X-axis direction in the horizontal plane is defined as a Y-axis direction, and a direction orthogonal to the X-axis direction and the Y-axis direction (that is, a vertical direction) respectively is defined as a Z-axis direction.

Referring now to FIG. 1, a general configuration of the printer 1 will be described briefly. In FIG. 1, although almost all rollers are drawn on the same plane in order to illustrate rollers arranged on the sheet transporting route of the printer 1, the positions in the depth direction (Y-axis direction) do not necessarily match (might match).

The printer 1 includes a paper feeding device (sheet material feeding device) 2, and is configured to feed papers (sheet material) P as recording media one by one from the paper feeding device 2, perform ink jet recording in a recording unit (recorder) 4, and discharge the printed papers toward a discharged paper stacker, not shown, provided on the front side of the apparatus (+X side). Also, the printer 1 detachably includes a double-side unit 7 at the rear portion of the apparatus, and is capable of curving and inverting the paper P so that a second surface which is the opposite side of a first surface of the paper P subjected to recording first, whereby recording on both surfaces of the paper P can be performed.

The paper feeding device 2 includes a paper cassette (supporting unit) 11, a pickup roller 16, and a separating unit 21. The paper cassette 11 which are capable of accommodating the plurality of papers P in the stacked manner is configured to be mountable and demountable with respect to an apparatus body of paper feeding device 2 from the front side of the apparatus. The pickup roller 16 rotated by a motor, not shown, is provided in a pivoting member 17 pivoting about a pivoting shaft 18, and is configured to feed a topmost paper P from the paper cassette 11 in a −X direction (feeding direction) by coming into contact with the paper stored in the paper cassette 11 and being rotated.

A separating member 12 is provided at a position opposing leading edges of the papers stored in the paper cassette 11, and when the leading edge of the topmost paper P to be fed advances toward the downstream while keeping in sliding contact with the separating member 12, first-stage separation from the papers P from the next onward is performed. Provided on the downstream side of the separating member 12 is the separating unit 21 having a separating roller 22 and an intermediate roller 23 and performing second-stage separation of the paper P. Provided on the downstream side of the separating unit 21 is an assist roller 27 rotated by the intermediate roller 23 while nipping the paper P therebetween.

The paper feeding device 2 includes a transporting unit 5 and a discharging unit 6. The transporting unit 5 includes a transporting driving roller 35 rotated by the motor, not shown, and a transporting driven roller 36 supported by a guide opposing portion 37 via a shaft so as to be rotated in press contact with the transporting driving roller 35, and the paper P is accurately fed by the transporting unit 5 toward a position opposing the recording head 42.

A paper edge sensor 13 is provided on the guide opposing portion 37 on the upstream side of the transporting unit 5. The paper edge sensor 13 is a sensor configured to detect the position at a leading edge and a trailing edge of the paper P and, in the first embodiment, employs a mechanical sensor sensing the edge of the paper P by a mechanical mechanism. More specifically, the paper edge sensor 13 includes a lever projecting from the guide opposing portion 37 on a second transporting route 9 (described later) and rotatable about a shaft extending in the Y-axis direction, and is configured to sense the edge of the paper P by sensing the rotation of the lever upon coming into contact with the paper P.

The skew of the paper P fed by the paper feeding device 2 is removed by a nipping-and-releasing type screw elimination using the transporting driving roller 35 (first transporting roller) and the intermediate roller 23 (second transporting roller) on the upstream side thereof.

Specifically, the leading edge of the paper P is nipped between the transporting driving roller 35 and the transporting driven roller 36 and is fed by a predetermined amount in the normal direction (toward the downstream), and then the transporting driving roller 35 is rotated reversely in a state in which the intermediate roller 23 on the upstream side is rotated in the normal direction, whereby the leading edge of the paper is released in the reverse feeding direction (toward the upstream) of the transporting driving roller 35. Accordingly, the paper P is sagged between the intermediate roller 23 and the transporting driving roller 35, and the leading edge of the paper P follows a nip point between the transporting driving roller 35 and the transporting driven roller 36, so that the skew is corrected.

Subsequently, the recording head 42 is provided on a bottom portion of a carriage 40, and the carriage 40 is driven so as to reciprocate in a primary scanning direction by the motor, not shown, while being guided by a carriage guide shaft 41 extending in the primary scanning direction (Y-axis direction). The recording head 42 is configured to be capable of discharging inks in respective colors, for example, yellow (Y), magenta (M), cyan (C), and black (K).

The discharging unit 6 provided on the downstream side of the recording head 42 includes a discharge driving roller 44 rotated by the motor, not shown, and a discharge driven roller 45 rotated by coming into contact with the discharge driving roller 44, and the paper P subjected to printing by the recording unit 4 is discharged to a stacker, not shown, provided on the front side of the apparatus by the discharging unit 6.

The paper feeding device 2 includes a first transporting route 8 configured to transport the paper P at a predetermined height, the second transporting route 9 configured to transport the paper P at a height lower than the first transporting route 8, and a joint portion 10 where the first transporting route 8 and the second transporting route 9 join. In the first transporting route 8, the paper P is transported by the separating roller 22, the intermediate roller 23, and the assist roller 27. In the second transporting route 9, the paper P is transported by the transporting driving roller 35, the transporting driven roller 36, the discharge driving roller 44, and the discharge driven roller 45.

The second transporting route 9 (9A) on the downstream side of the joint portion 10 constitutes a common transporting route which guides the paper P to the recording head 42. In contrast, the second transporting route 9 (9B) on the upstream side of the joint portion 10 constitutes a paper inverting transporting route which joins the first transporting route 8 on the upstream side of the joint portion 10.

In the case of the duplex printing, the paper P transported in the second transporting route 9A and subjected to the printing on the first surface is guided into the second transporting route 9B with the side which corresponds to the trailing edge of the paper when the printing is performed on the first surface is inverted to the leading edge by the reverse feeding actions of the transporting unit 5 and the discharging unit 6, and is guided into a nip between the separating roller 22 and the intermediate roller 23.

The intermediate roller 23 is rotated clockwise in FIG. 1 by the motor, not shown, and the paper guided into the nip between the separating roller 22 and the intermediate roller 23 passes between the intermediate roller 23 and the assist roller 27, reaches the joint portion 10 again, and then is guided to the recording unit 4 via the second transporting route 9A, where the printing is carried out in the same manner from then onward.

The rollers to be rotated, which are provided on the paper transporting route described above, namely, the pickup roller 16, the intermediate roller 23, the transporting driving roller 35, and the discharge driving roller 44, are configured to be rotated by the common drive motor.

Referring now to FIG. 2 to FIG. 6, characteristic configurations of the paper feeding device 2 according to the first embodiment of the invention will be described in detail.

Figure 2:
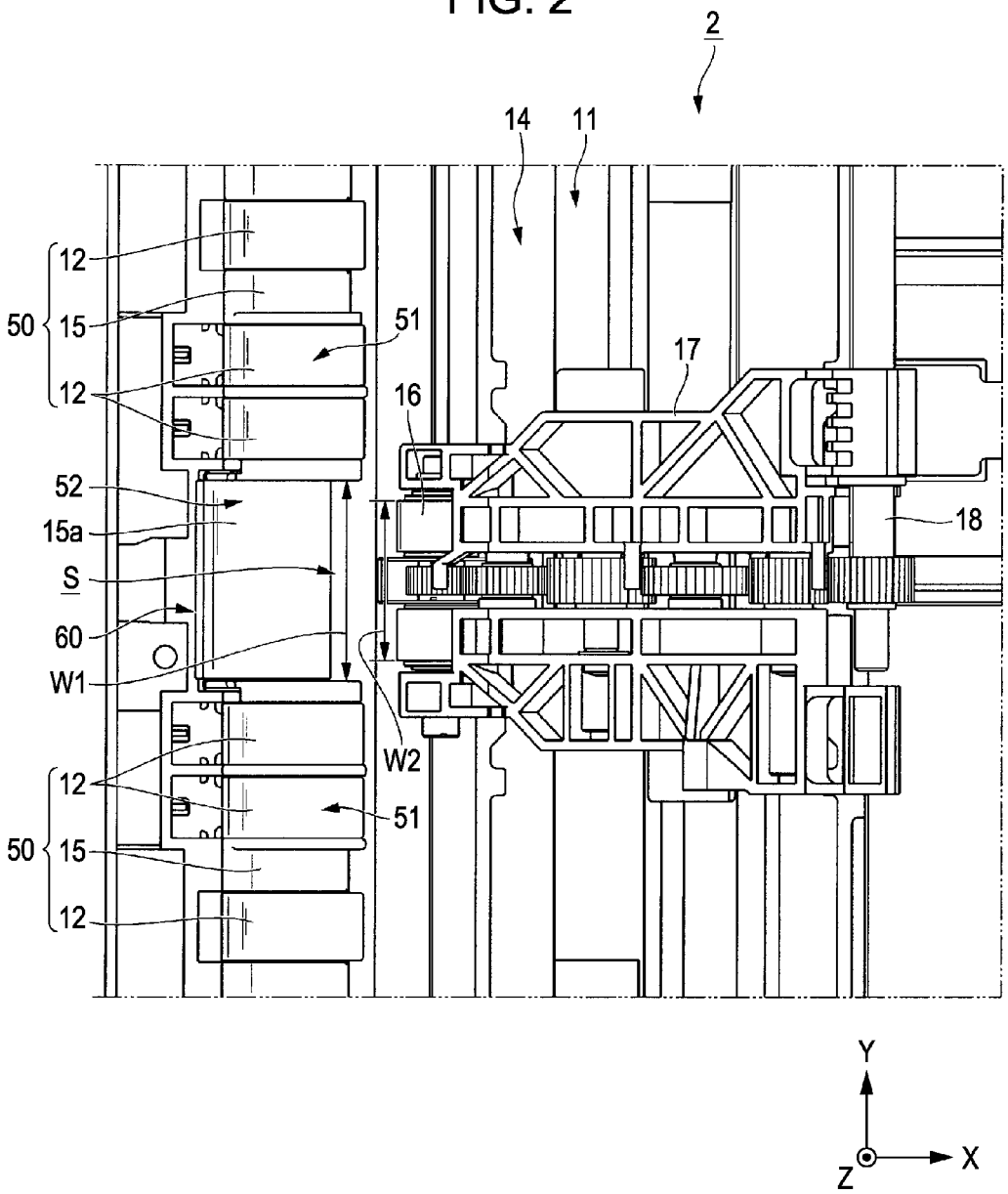
FIG. 2 is a plan view showing a configuration of a principle portion of a feeding device in the first embodiment of the invention.
Figure 3:
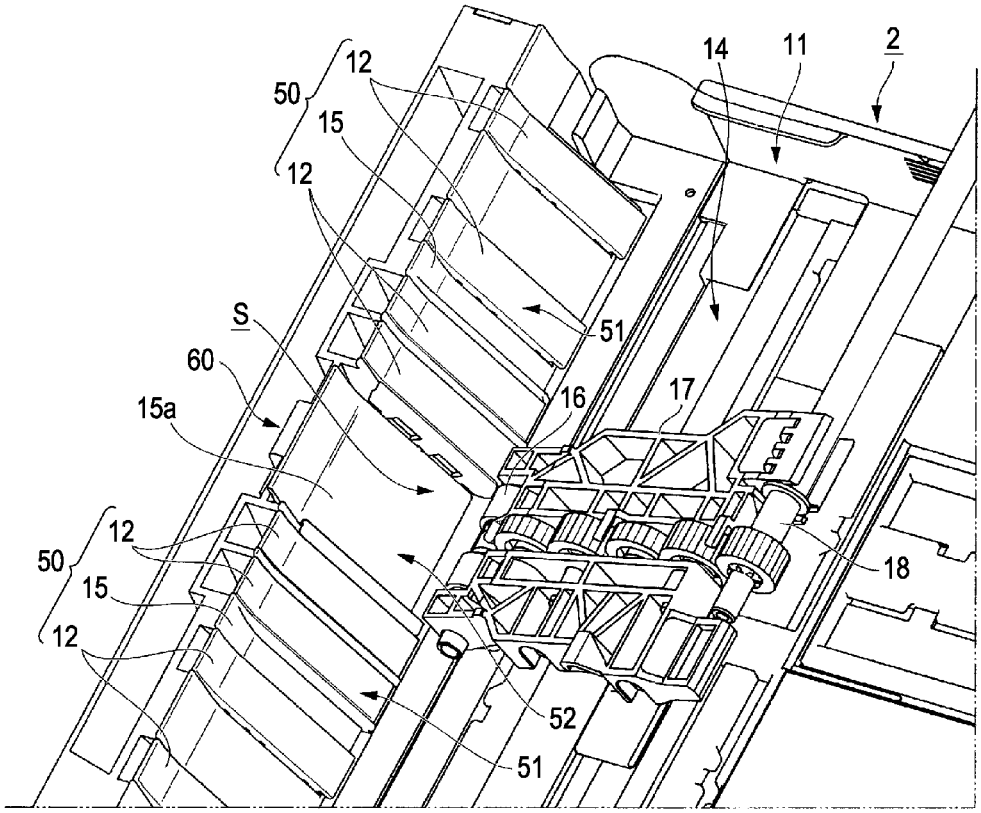
FIG. 3 is a perspective view showing the configuration of the principal portion of the feeding device according to the first embodiment of the invention.

FIG. 2 is a plan view showing a configuration of a principal portion of the paper feeding device 2 according to the first embodiment of the invention. FIG. 3 is a perspective view showing the configuration of the principal portion of the paper feeding device 2 according to the first embodiment of the invention.

A separating bevel 50 having the separating members 12 is provided in the −X direction (feeding direction) of the paper cassette 11. The separating bevel 50 includes an inclined plane 51 inclined at a predetermined angle with respect to a supporting surface 14 which supports the paper P of the paper cassette 11. The supporting surface 14 extends on the X-Y plane and is configured to support the papers P in the stacked manner. In the paper cassette 11 in the first embodiment, the papers P having different rigidities (for example, normal papers, specific papers (photo papers, double postal cards)) are stacked in a mixed state.

An inclined plane 51 is defined by a bank portion 15 of the paper cassette 11 and the separating members 12 fixed to the bank portion 15. A plurality of the separating members 12 are provided and are arranged in parallel at predetermined intervals along the bank portion 15 in the Y-axis direction. The separating members 12 are formed of a high μ (coefficient of friction) resin material which causes a higher frictional force than that of the bank portion 15 to be generated for the paper P. The separating members 12 and the bank portion 15 have a substantially same angle of inclination. The inclined plane 51 formed of the separating members 12 is positioned on the upstream side (+X side) in the feeding direction with respect to the inclined plane 51 formed by the bank portion 15, and the separation of the paper P is performed by the separating members 12. The angle of the inclined plane 51 with respect to the supporting surface 14 is set to be a larger angle than the normal angle of inclination for separation with respect to the specific papers (on the order of 60 degrees).

In the −X direction (feeding direction) of the paper cassette 11, a space forming member 60 that forms a space S in part of the inclined plane 51 of the separating bevel 50 is provided. The space forming member 60 forms the space S for letting part of the paper P to escape in the −X direction in part of an area opposing the pickup roller 16 in the feeding direction (X-axis direction). The −X side of the space S in the first embodiment is formed by a second bank portion 1*a* having an inclined plane 52 at substantially the same angle as the inclined plane 51. The inclined plane 52 formed by the second bank portion 15*a* is positioned on the downstream side (−X side) of the inclined plane 51 defined by the separating members 12 and the bank portion 15 in the feeding direction. In the first embodiment, the second bank portion 15*a* is provided. However, as it is aimed for making the part of the paper P difficult to abut, the corresponding portion may be a complete space.

Figure 4:
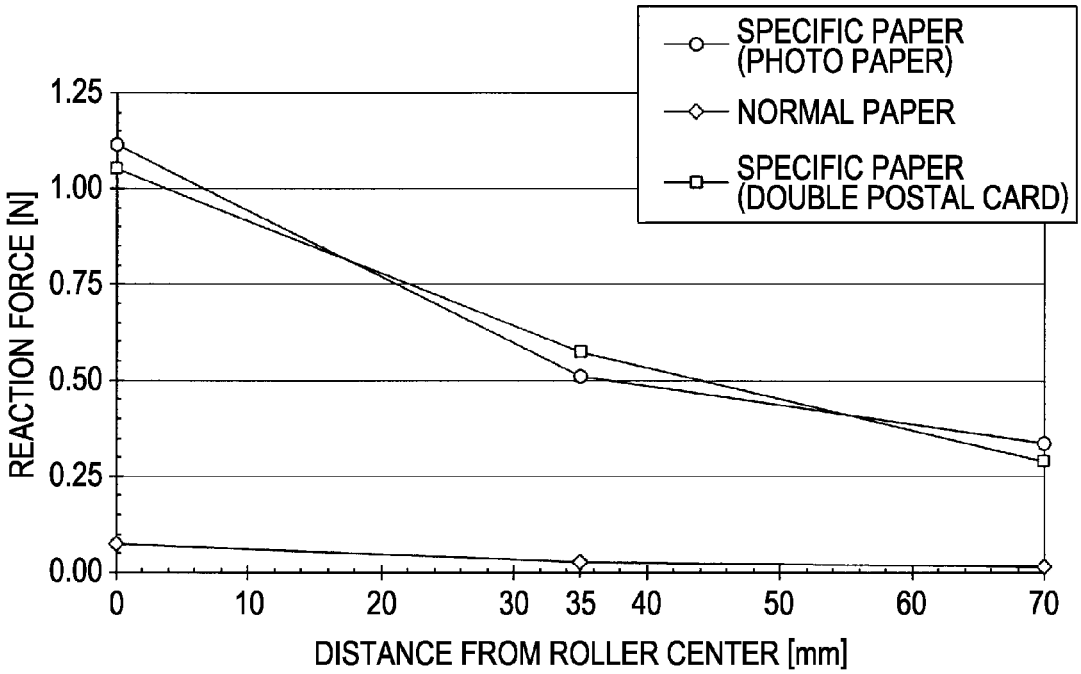
FIG. 4 is a graph showing distributions of paper reaction force (horizontal component) according to column numbers when papers come into abutment with an inclined plane of a separating bevel having no space forming member.

A space width W1 in the Y-axis direction of the space S in the first embodiment is set on the basis of a width W2 of the pickup roller 16 in the direction of the axis (Y-axis direction) and the rigidity of the paper P stacked in the paper cassette 11. Referring now to FIG. 4 and FIG. 5, the effect of the space S and the length of the space width W1 will be described.

FIG. 4 is a graph showing distributions of paper reaction force (horizontal component) according to column numbers when the papers P come into abutment with the inclined plane 51 of the separating bevel 50 having no space forming member 60.

The lateral axis of the graph in FIG. 4 represents a distance (mm) in the paper width direction (Y-axis direction, direction of the column) from the axial center position of the pickup roller 16 to a measuring point, and the vertical axis represents a paper reaction force (N) at the measuring point. In FIG. 4, distributions of the loads of three types of papers P having different rigidities of A4 size (210 mm in width×297 mm in length) of JIS standard, specifically, a normal paper, a photo paper as the specific paper, and a double postal card. A feeding force of the pickup roller 16 to feed the paper P (rotary drive force) is constant.

As shown in FIG. 4, it is understood that the paper reaction force reaches its peak at the center position (0 mm) of the pickup roller 16 and the paper reaction force is reduced as it goes farther from the center position common to all the paper type. Therefore, the distributions of the paper reaction forces in the paper width direction are monomodal being centered on the center position. In other words, it is understood that the position opposing the pickup roller 16 in the feeding direction is a position where the paper reaction force becomes maximum.

As shown in FIG. 4, the degrees of the magnitude of the paper reaction force and inclination of the distribution of the paper reaction force are different between the normal paper and the specific paper. In other words, it is understood that the paper reaction force of the specific paper is larger than that of the normal paper at the center position, and is lowered abruptly as it goes away from the center position. In contrast, although the paper reaction force of the normal paper is lowered as it goes away from the center position, since the paper reaction force at the center position is smaller than that of the specific paper, the degree of lowering of the reaction force is smaller and the lowering width is also minute in comparison with the cases of two types of specific papers, and the change in paper reaction force in the paper width direction is light.

The difference in paper reaction forces is caused by the difference in rigidity, that is, the fact that the rigidity of the normal paper is low and the rigidity of the specific paper is high. In other words, since the specific papers for example have high rigidity, the specific papers can hardly achieve buckling (flexure, bending) deformation when being abutted with the separating bevel 50 and hence it is difficult to be fed along the inclined plane 51. Therefore, the paper reaction force is increased. In contrast, since the normal papers for example have low rigidity, the normal papers can easily achieve buckling (flexure, bending) deformation when being abutted with the separating bevel 50 and hence it is easy to be fed along the inclined plane 51. Therefore, the paper reaction force is reduced.

FIG. 5 is a graph for describing the difference in paper rigidity between the specific paper (photo paper) and the normal paper.

As shown in FIG. 5, the paper size of the both types of papers are the same, A4 size. However, the paper materials are different between the specific paper and the normal paper. For example, in the case of the photo paper, a coating layer for improving the image quality or the texture is formed on the surface thereof. Therefore, the thickness of the photo paper is approximately three times larger than that of the normal paper.

The index which indicates the rigidity of the paper P is expressed by a product (EI) of a Young's Modulus (E) and a geometrical moment of inertia (I) of the paper P. As shown in FIG. 5, it is understood that the photo paper has approximately sixty-five times rigidity of the normal paper.

As described thus far, in the inclined plane 51 of the separating bevel 50, the position opposing the pickup roller 16 in the feeding direction is a position having the largest paper reaction force as shown in FIG. 4. In comparison with the specific papers having high rigidity, the change in paper reaction force in the paper width direction of the normal paper having low rigidity is light and minute.

Therefore, as in the first embodiment, when the space S is formed by depressing the inclined plane 51 in the feeding direction, the inclined plane 51 being the area opposing the pickup roller 16 in the feeding direction, the load applied on the specific paper having high rigidity can be lowered significantly. On the other hand, there is no significant effect on the lowering of the load applied on the normal paper having low rigidity. Therefore, even when the inclined plane 51 of the separating bevel 50 is set to an angle larger than the normal angle of inclination for separation with respect to the specific papers, for example, to an angle of inclination for separation which also supports the normal paper as in the first embodiment, the load applied only on the specific papers having the high rigidity is significantly lowered, so that the no-feed phenomenon can be prevented.

In the first embodiment, in order to obtain a sufficient effect of the space S, the space width W1 of the space S is set on the basis of the width W2 of the pickup roller 16 in the axial direction and the rigidity of the paper P which affect the distribution of the paper reaction force. In other words, when the width W2 of the pickup roller 16 is changed, the area which applies a force on the paper P is changed and affects the distribution of the paper reaction force (specifically, the range having a large paper reaction force). The width W2 of the pickup roller used in the experiment shown in FIG. 4, and the width W2 of the pickup roller 16 in the first embodiment are 28.2 mm.

Basically, the larger the space width W1, the more the load of the specific paper can be lowered as shown in FIG. 4. However, the probability of flection of the paper P increases with increase in the space width W1. Therefore, if the space width W1 is increased too much, significant change in position of the paper P occurs when being fed, and hence the paper P may be creased. When such a crease occurs, the load is generated at the creased portion, so that the effect of the space S may be lowered.

From these reasons, a range of 20 mm to 50 mm is effective as the space width W1 of the space S in the first embodiment, and a width of 35 mm is the most preferable. This value is a value when the paper is A4 sized paper (210 mm). Therefore, when the paper width is different from that of the A4 size (for example, A3 of JIS standard), the value of the space width W1 is different depending on the paper width.

In other words, if expressed in percentage with respect to the paper width (100%), a range of 12% to 24% is effective as the space width W1 of the space S, and a ratio of 17% is the most preferable.

When the space S is formed in the area opposing the pickup roller 16 in the feeding direction, following effects are achieved.

Figure 6:
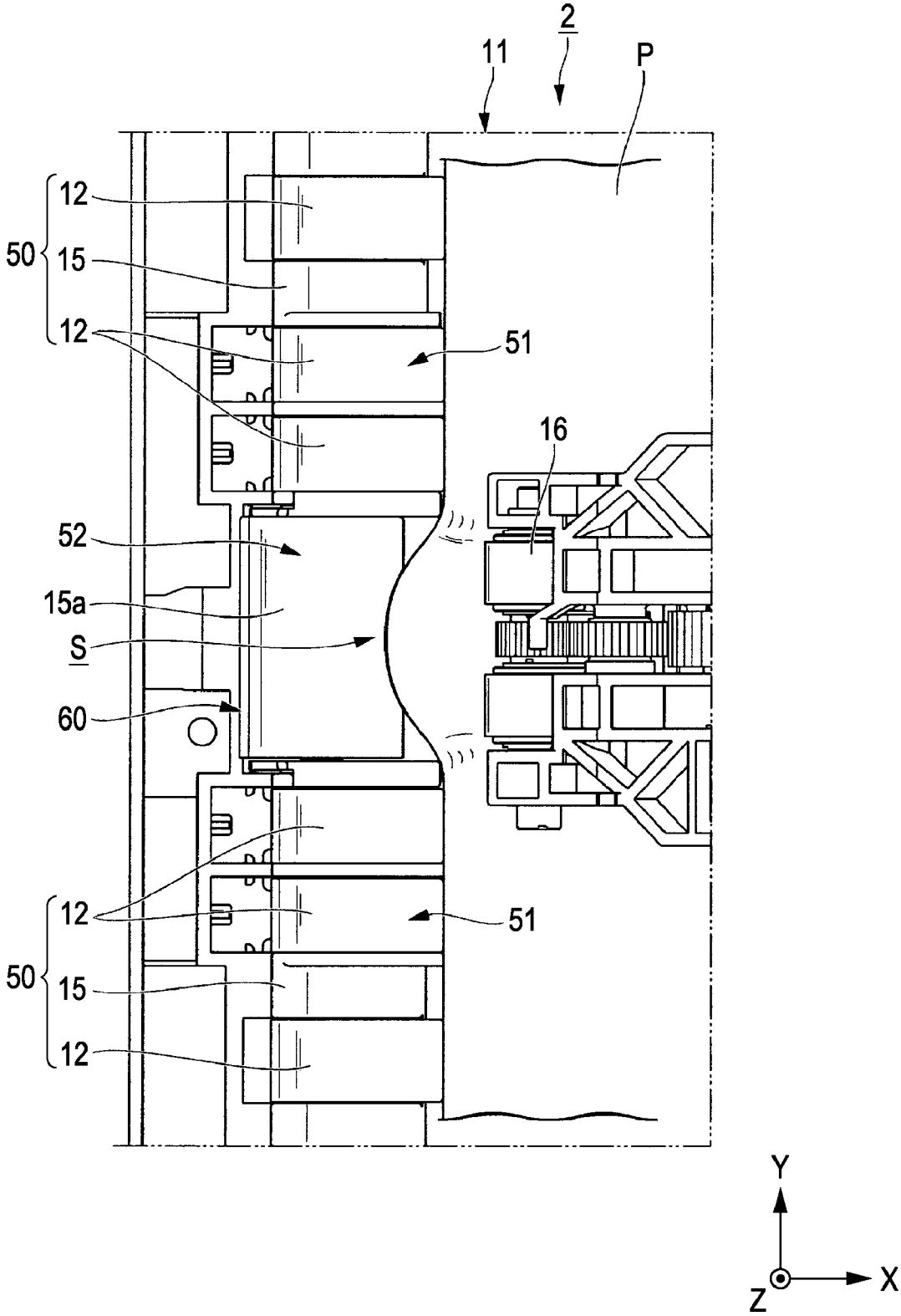
FIG. 6 is a drawing schematically showing a state in which a paper (specific paper) having high rigidity is fed to the separating bevel according to the first embodiment of the invention.

FIG. 6 is a drawing schematically showing a state in which the paper P (specific paper) having high rigidity is fed to the separating bevel 50 in the first embodiment of the invention.

As shown in FIG. 6, when the paper P is fed in the −X direction by the rotation of the pickup roller 16 and abuts against the inclined plane 51 of the separating bevel 50, since the space S is formed on part of the inclined plane 51, the part of the paper P escapes into the space S.

In this manner, when the area opposing the pickup roller 16 is depressed in the feeding direction (−X direction), in the corresponding area, the distance for allowing the deformation of the paper P can be partly elongated. Therefore, in this area, the bending radius of the paper P having high rigidity can be increased to reduce the load. If the part of the paper P escapes into the space S when the paper P comes into abutment with the inclined plane 51 of the separating bevel 50, the paper P is subjected to buckling deformation or waving deformation at a boundary between the space S and the inclined plane 51, so that the paper P having high rigidity can easily be deformed from the deformed portion as a starting point, and feeding along the inclined plane 51 is facilitated.

Therefore, it is not necessary to take the distance between the inclined plane 51 and the pickup roller 16 or to reduce the angle of the inclined plane 51 as in the related art, so that downsizing of the apparatus is achieved.

Therefore, according to the first embodiment described above, with the employment of the paper feeding device 2 having the paper cassette 11 configured to support a plurality of the papers Pin a stacked manner, the separating bevel 50 having the inclined plane 51 inclined at a predetermined angle with respect to the supporting surface 14 of the paper cassette 11 and configured to separate the paper P coming into abutment with the inclined plane 51, the pickup roller 16 configured to feed the paper P toward the separating bevel 50 by coming into contact with the topmost paper P from among the papers P supported by the paper cassette 11 and being rotated thereon, and the space forming member 60 configured to form the space S for letting part of the paper P to escape in the feeding direction on part of the inclined plane 51 in the area opposing the pickup roller 16 in the feeding direction, highly reliable separation of the papers P having different rigidities is realized, and downsizing of the apparatus is achieved.

Since the highly reliable separation of the papers P having different rigidities is realized, defective feeding of the paper P due to the paper jam caused by double feed or non-feed is avoided. In addition, the downsizing of the apparatus is achieved, so that the printer 1 which allows space saving is obtained.

Second Embodiment

Subsequently, a second embodiment of the invention will be described. In the following description, the same or equivalent components as/to those in the above-described embodiment are designated by the same reference numerals, and the description thereof is simplified or omitted.

Figure 7:
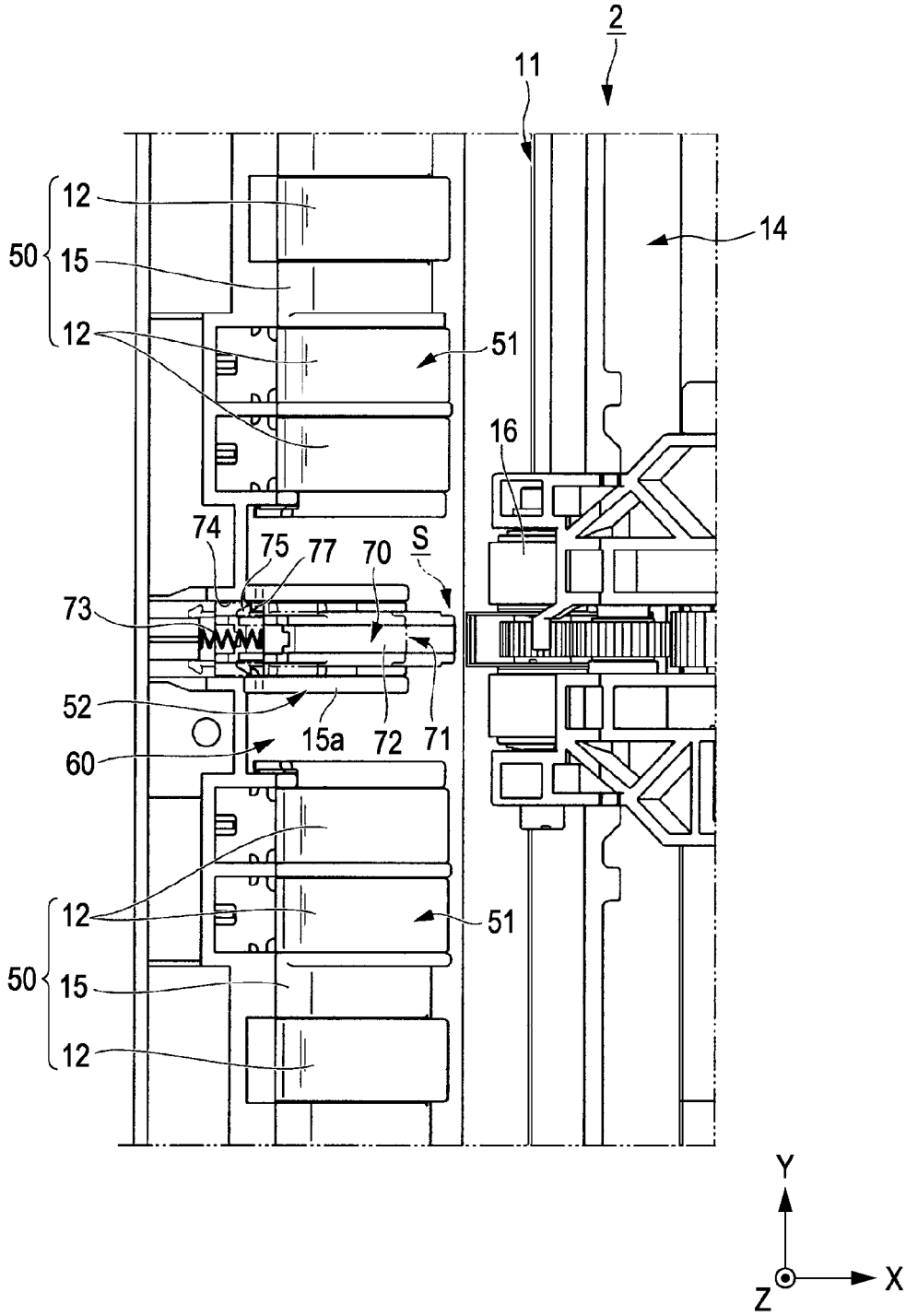
FIG. 7 is a plan view showing a configuration of a principle portion of the feeding device in a second embodiment of the invention.

FIG. 7 is a plan view showing a configuration of a principal portion of the paper feeding device 2 in the second embodiment of the invention.

When the space S for letting part of the paper to escape is formed on the inclined plane 51 of the separating bevel 50 as described above, the load applied to the paper P having high rigidity can be reduced, but the load applied to the paper P having low rigidity is slightly affected as well. Therefore, the paper feeding device 2 in the second embodiment is configured as described below in order to ensure the highly reliable separation of the papers P having different rigidities.

In the space forming member 60 in the second embodiment, a second separating bevel 70 is provided. The second separating bevel 70 is movable between a space forming position at which the space S is formed (shown by a double-dashed chain line in FIG. 7) and a position of separation where a substantially same surface as the inclined plane 51 is formed (shown by a solid line in FIG. 7) as shown in FIG. 7. The second separating bevel 70 is arranged at a center position opposing the pickup roller 16 in the feeding direction. The second separating bevel 70 includes a second separating member 72 having an inclined plane 71 at a substantially same angle of inclination as the inclined planes 51 and 52, and movable in the X-axis direction between the space forming position and the position of separation, and a spring member (urging device) 73 configured to urge the second separating member 72 toward the position of separation at a predetermined urging force. The second separating member 72 is formed of a block material having a substantially right angled triangle, whereof the inclined plane 71 corresponds to the oblique line.

The second bank portion 15*a* in the second embodiment is provided with a guide unit 74 configured to guide the second separating member 72 in the X-axis direction. The second separating member 72 is provided with a pair of stoppers 75 extending rearward (in the −X direction). Distal end portions of the stoppers 75 are formed into a hook shape and, when the second separating member 72 is positioned on the position of separation, the hook shaped portion engage projections 77 projecting from both side walls of the guide unit 74 in the Y-direction, so that the movement of the second separating member 72 in the +X direction is restricted.

The spring member 73 is arranged between the second separating member 72 and the guide unit 74, and is provided so as to be expandable in the X-axis direction. The spring member 73 is configured to apply a predetermined urging force to the second separating member 72 in the +X direction toward the position of separation in the normal state. An urging force of the spring member 73 is set to a value which causes the second separating member 72 to be positioned at the position of separation when the normal paper having low rigidity is fed, and to be positioned in the space forming position by being pushed thereto by the specific paper when the specific paper having high rigidity is fed.

The urging force of the spring member 73 in the normal state is set, for example, on the basis of the paper reaction force shown in FIG. 4. Since the second separating member 72 in the second embodiment is arranged at the center position (0 mm), in order to move the second separating member 72 as described above, the urging force of the spring member 73 may be set to a value between the value of the paper reaction force of the normal paper and the value of the paper reaction force of the specific paper at the corresponding position. The urging force of the spring member 73 in the normal state in the second embodiment is set to a value, for example, on the order of 0.2 N.

Figure 8:
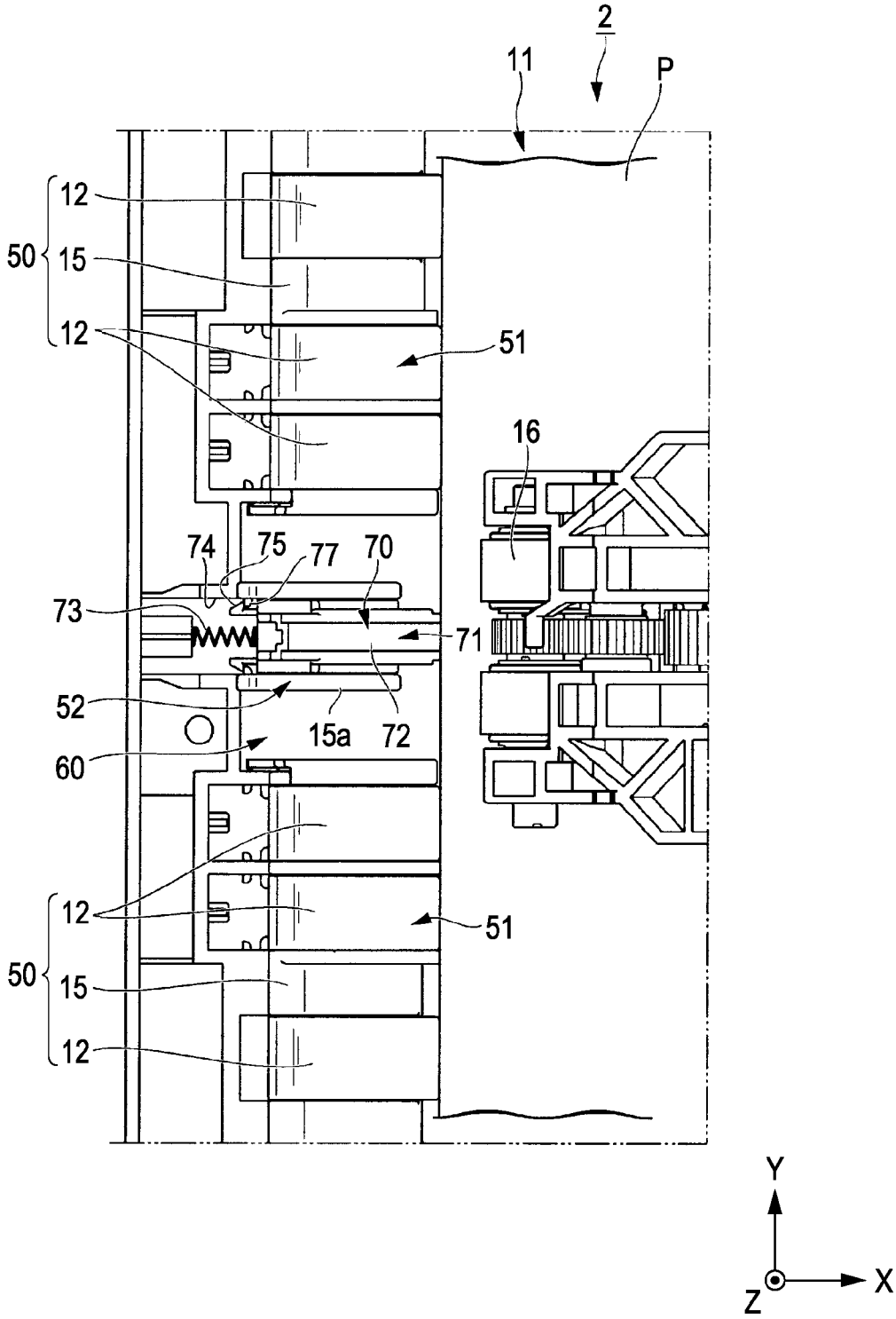
FIG. 8 is a drawing schematically showing a state in which a normal paper having low rigidity is fed to the separating bevel according to the second embodiment of the invention.
Figure 9:
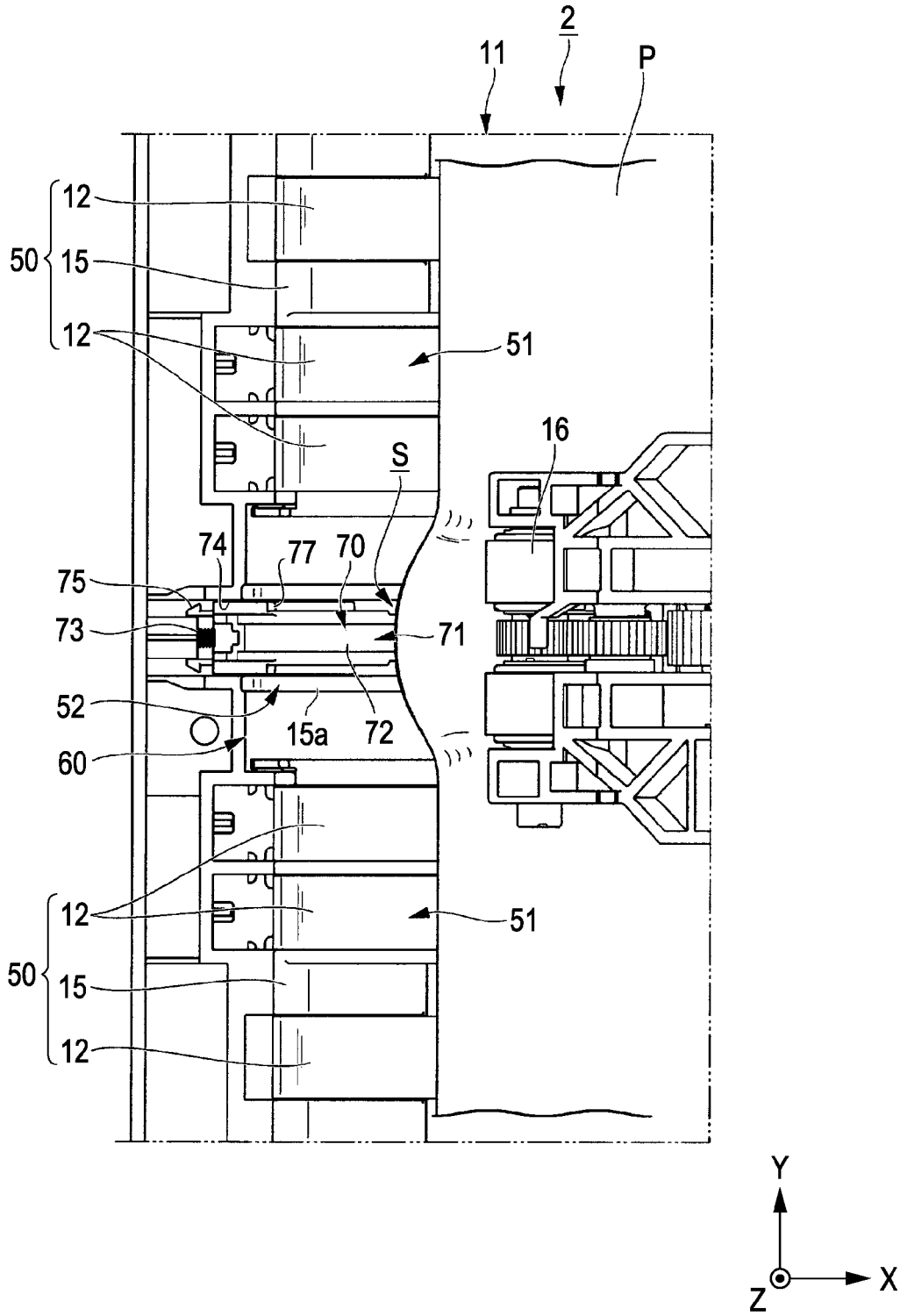
FIG. 9 is a drawing schematically showing a state in which a specific paper having high rigidity is fed to the separating bevel according to the second embodiment of the invention.

Referring now to FIG. 8 and FIG. 9, the action (operation) of the second separating bevel 70 having the configuration as described above will be described.

FIG. 8 is a drawing schematically showing a state in which a normal paper P1 having low rigidity is fed to the separating bevel 50 in the second embodiment of the invention. FIG. 9 is a drawing schematically showing a state in which a specific paper P2 having high rigidity is fed to the separating bevel 50 in the second embodiment of the invention.

As shown in FIG. 8, when the normal paper P1 having low rigidity is fed by the rotation of the pickup roller 16 in the −X direction, the normal paper P1 comes into abutment with the inclined plane 51 of the separating bevel 50 and the inclined plane 71 of the second separating bevel 70 which is substantially flush with the inclined plane 51.

The second separating member 72 is urged by the spring member 73 in the +X direction, and is set to provide an urging force to be larger than the load of the normal paper P1 at the corresponding point. Therefore, the second separating member 72 waits at the position of separation without being pushed inward by the normal paper P1. The second separating member 72 positioned at the position of separation comes into abutment at the inclined plane 71 thereof with the normal paper P1 at the center position and provides a load for separation. Therefore, reduction of the load applied to the normal paper P1 due to the provision of the space forming member 60 is prevented. Therefore, separation with high reliability with less probability of the double feed is realized.

In contrast, as shown in FIG. 9, when the specific paper P2 having high rigidity is fed by the rotation of the pickup roller 16 in the −X direction, the specific paper P2 comes into abutment with the inclined plane 51 of the separating bevel 50 and the inclined plane 71 of the second separating bevel 70 which is substantially flush with the inclined plane 51.

Since the second separating member 72 is urged by the spring member 73 in the +X direction by the spring member 73, and is set to provide an urging force to be smaller than the load of the specific paper P2 at the corresponding point. Therefore, the second separating member 72 is pushed inward against the urging force by the specific paper P2 and is moved from the position of separation to the space forming position. The second separating member 72 positioned at the space forming position is the substantially flush with the inclined plane 52 of the second bank portion 15*a*, and forms the space S. When the space S is formed, the load of the specific paper P2 is lowered and hence the specific paper P2 can easily be deformed as described above, so that a reliable paper feeding with less probability of the non-feed phenomenon is realized.

When the abutment against the specific paper P2 is released, the second separating member 72 automatically moves from the space forming position to the position of separation by being urged by the spring member 73 to prepare for the next paper feeding at the position of separation.

Therefore, according to the second embodiment, the space forming member 60 is configured to include the second separating bevel 70 which is movable between the space forming position where the space S is formed and the position of separation which forms a plane substantially flush with the inclined plane 51 is formed. Therefore, when the specific paper P2 having high rigidity is fed, the load applied to the specific paper P2 is reduced by positioning the second separating bevel 70 in the space forming position. In contrast, when the normal paper P1 having low rigidity is fed, the second separating bevel 70 is positioned at the position of separation to be brought into abutment with the normal paper P1, so that reduction of the load is prevented. Therefore, the load to be applied to the normal paper P1 having low rigidity is increased, so that reliable separation with less probability of the double feed is realized.

Third Embodiment

Subsequently, a third embodiment of the invention will be described. In the following description, the same or equivalent components as/to those in the above-described embodiments are designated by the same reference numerals, and the description thereof is simplified or omitted.

Figure 10:
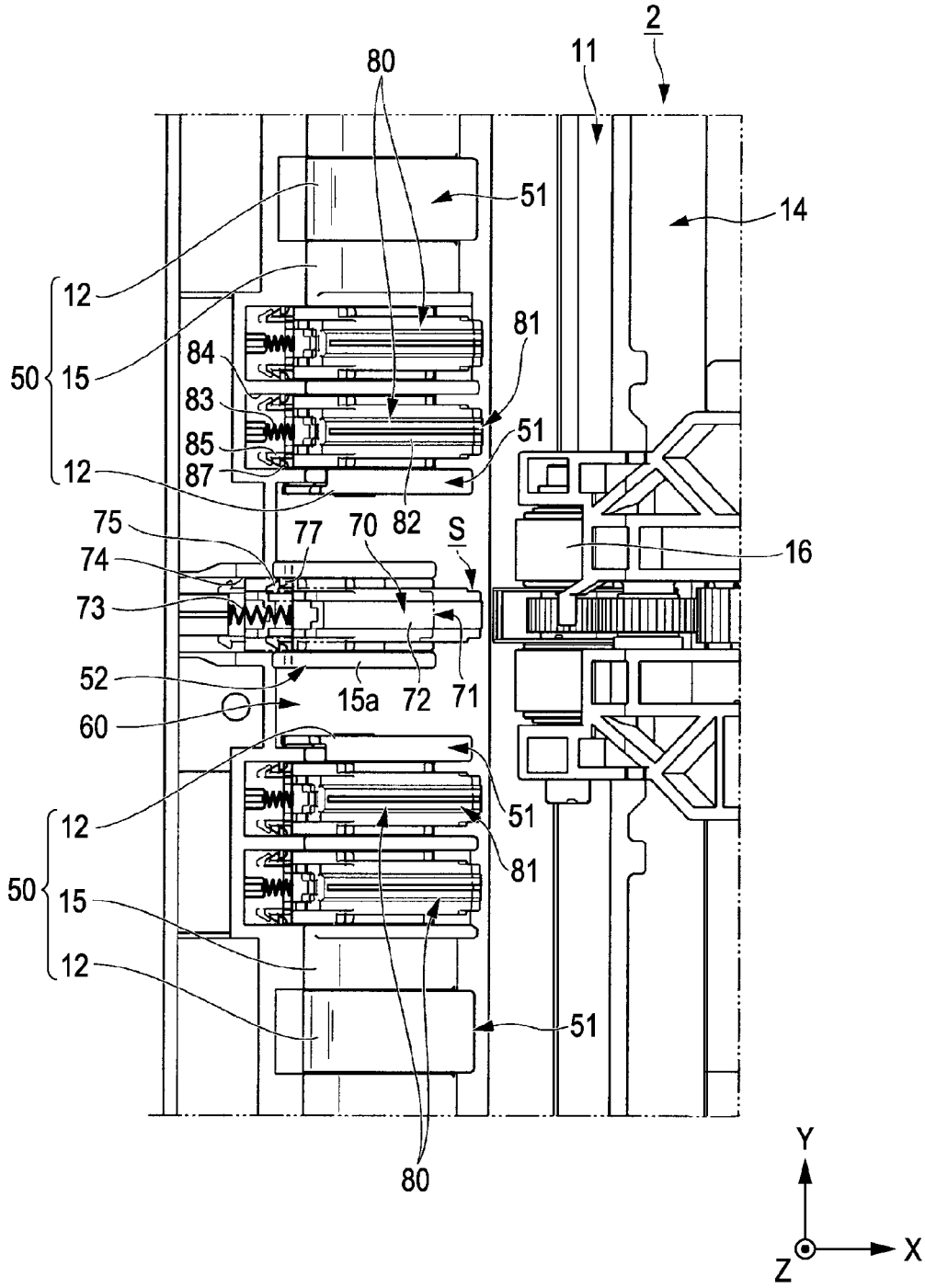
FIG. 10 is a plan view showing a configuration of a principle portion of the feeding device according to a third embodiment of the invention.

FIG. 10 is a plan view showing a configuration of a principal portion of the paper feeding device 2 in the third embodiment of the invention.

The paper feeding device 2 in the third embodiment is configured as described below in order to further ensure the highly reliable separation of the papers P having different rigidities.

In the third embodiment, as shown in FIG. 10, third separating bevels 80 provided on parts of the inclined plane 51 of the bank portion 15 and each having a second inclined plane 81 which demonstrates a higher frictional force than the inclined planes 51 of the separating members 12 are provided. The third separating bevels 80 are each provided so as to be movable between a second position of separation at which the second inclined plane 81 is positioned on the upstream side (+X side) in the feeding direction with respect to the inclined plane 51 (shown by a solid line in FIG. 10) and a third position of separation at which the inclined plane 51 and the second inclined plane 81 are substantially flush with each other (shown by a double-dashed chain line in FIG. 10). The third separating bevels 80 in the third embodiment are arranged outside the separating members 12 provided so as to interpose the space forming member 60 therebetween in the Y-axis direction, and two on the +Y side, and two on the −Y side, four in total are provided.

The third separating bevels 80 each include a third separating member 82 having the second inclined plane 81 and being movable between the second position of separation and the third position of separation in the X-axis direction, and a spring member (second urging device) 83 urging the third separating member 82 toward the second position of separation at a predetermined urging force. The third separating member 82 is formed of a block material having a substantially right angled triangle, whereof the second inclined plane 81 corresponds to the oblique line.

The bank portion 15 in the third embodiment is provided with a guide unit 84 configured to guide the third separating member 82 in the X-axis direction. The third separating member 82 are each provided with a pair of stoppers 85 extending rearward (in the −X direction). The distal end portions of the stoppers 85 are formed into a hook shape and, when the third separating member 82 are positioned on the second position of separation, the hook shaped portion engage projections 87 projecting from both side walls of the guide unit 84 in the Y-direction, so that the movement of the third separating member 82 in the +X direction is restricted.

The spring member 83 is arranged between the third separating member 82 and the guide unit 84, and is provided so as to be expandable in the X-axis direction. The spring member 83 is configured to apply a predetermined urging force to third separating member 82 in the +X direction toward the position of separation in the normal state. The urging force of the spring members 83 in the third embodiment are set to a value which causes the third separating member 82 to be positioned at the second position of separation when the normal paper having low rigidity is fed, and to be positioned in the third position of separation by being pushed thereto by the specific paper when the specific paper having high rigidity is fed.

The urging forces of the spring members 83 in the normal state are set, for example, on the basis of the paper reaction force shown in FIG. 4. In order to move the third separating member 82 as described above, the urging forces of the spring members 83 may be set to a value between the value of the paper reaction force of the normal paper and the value of the paper reaction force of the specific paper at the corresponding position. The urging forces of the spring members 83 in the normal state in the third embodiment are set to a value, for example, on the order of 0.2 N.

Figure 11:
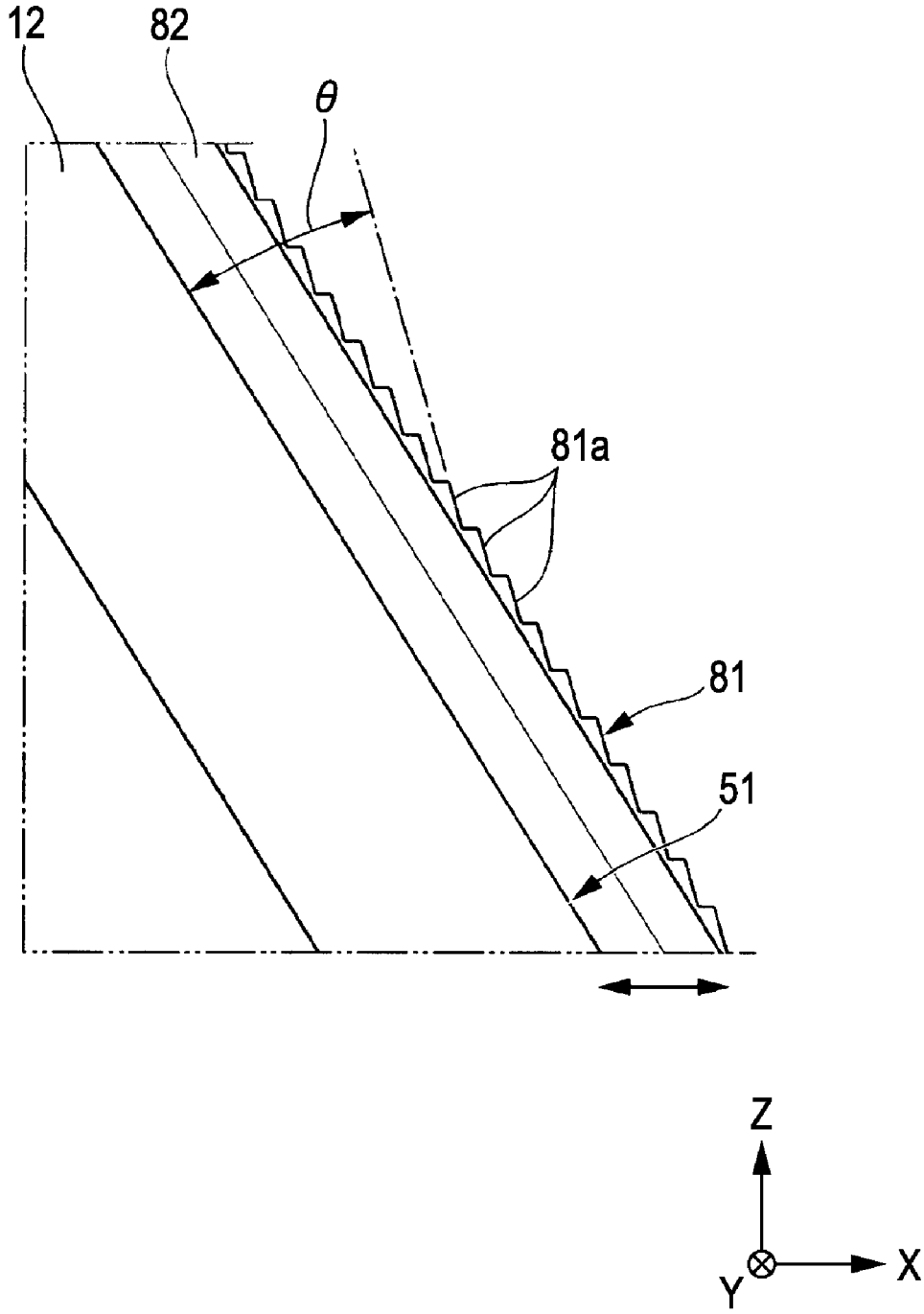
FIG. 11 is a left side view showing a configuration of a second inclined plane according to the third embodiment of the invention.

FIG. 11 is a left side view showing a configuration of the second inclined plane 81 according to the third embodiment of the invention.

As shown in FIG. 11, the second inclined plane 81 has the substantially same angle of inclination as the inclined plane 51 in general. However, the inclined plane is formed into a sawtooth shape or a staircase shape. Therefore, the coefficient of friction of the second inclined plane 81 is higher than the coefficient of friction of the inclined plane 51. Specifically, abutment surfaces 81*a* of the second inclined plane 81, which come into abutment with the paper P when being fed by the pickup roller 16, are formed at an angle (for example, approximately 70 degrees) larger than that of the inclined plane 51 (for example, approximately 60 degrees) by an angle θ. When the angle of inclination of the abutment surfaces 81*a* increases, the paper reaction force generated when the paper P comes into abutment can be increased.

In the third embodiment, for the purpose of compensating for the lowering of the load applied to the normal paper if the angle of inclination of the inclined plane 51 cannot be set to the angle of inclination for separation suitable for the separation of the normal paper because of the necessity of separation of the specific paper, the third separating bevels 80 each having the second inclined plane 81 which demonstrates a higher frictional force than the inclined plane 51 are provided.

Figure 12:
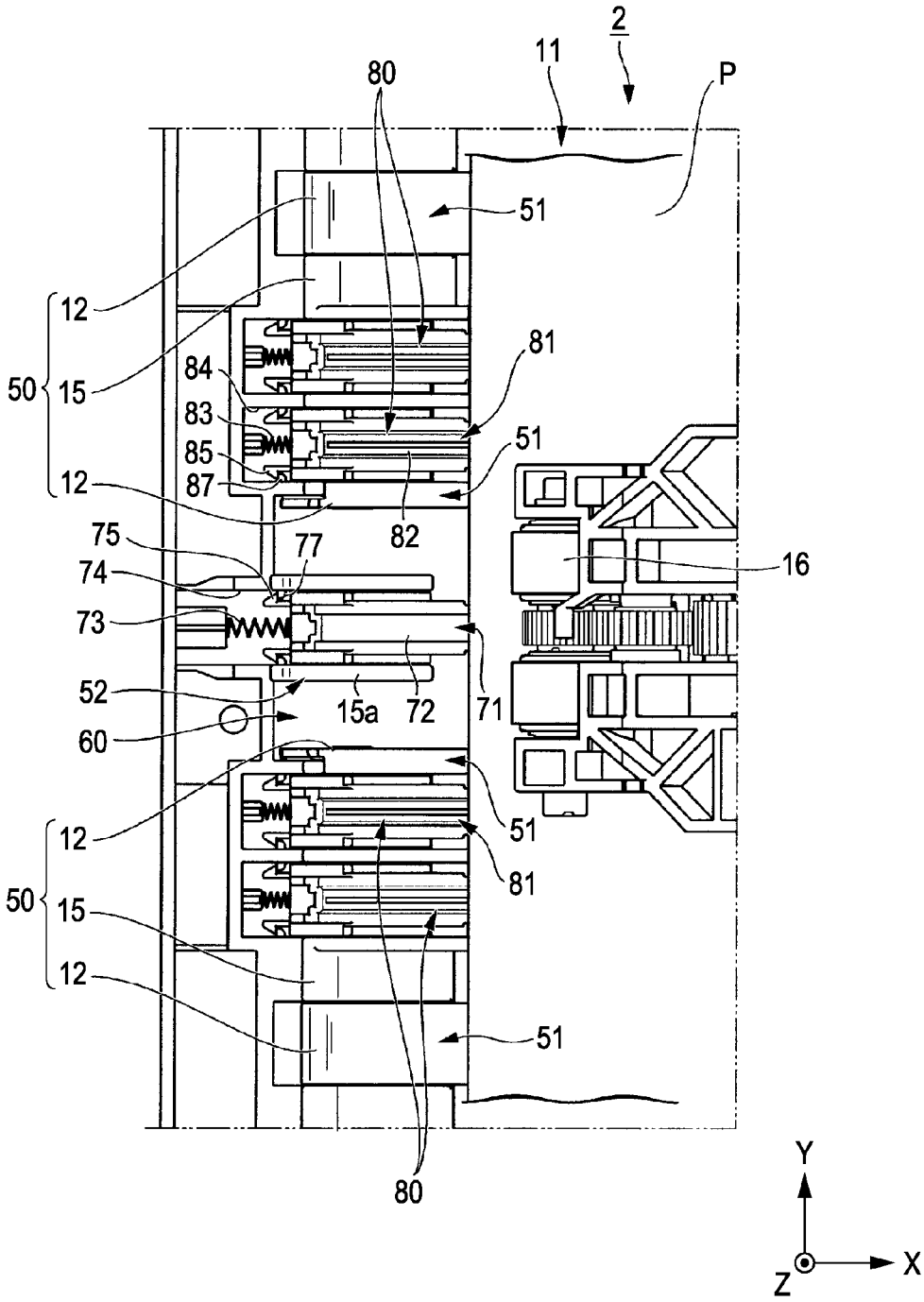
FIG. 12 is a drawing schematically showing a state in which the normal paper having low rigidity is fed to the separating bevel according to the third embodiment of the invention.
Figure 13:
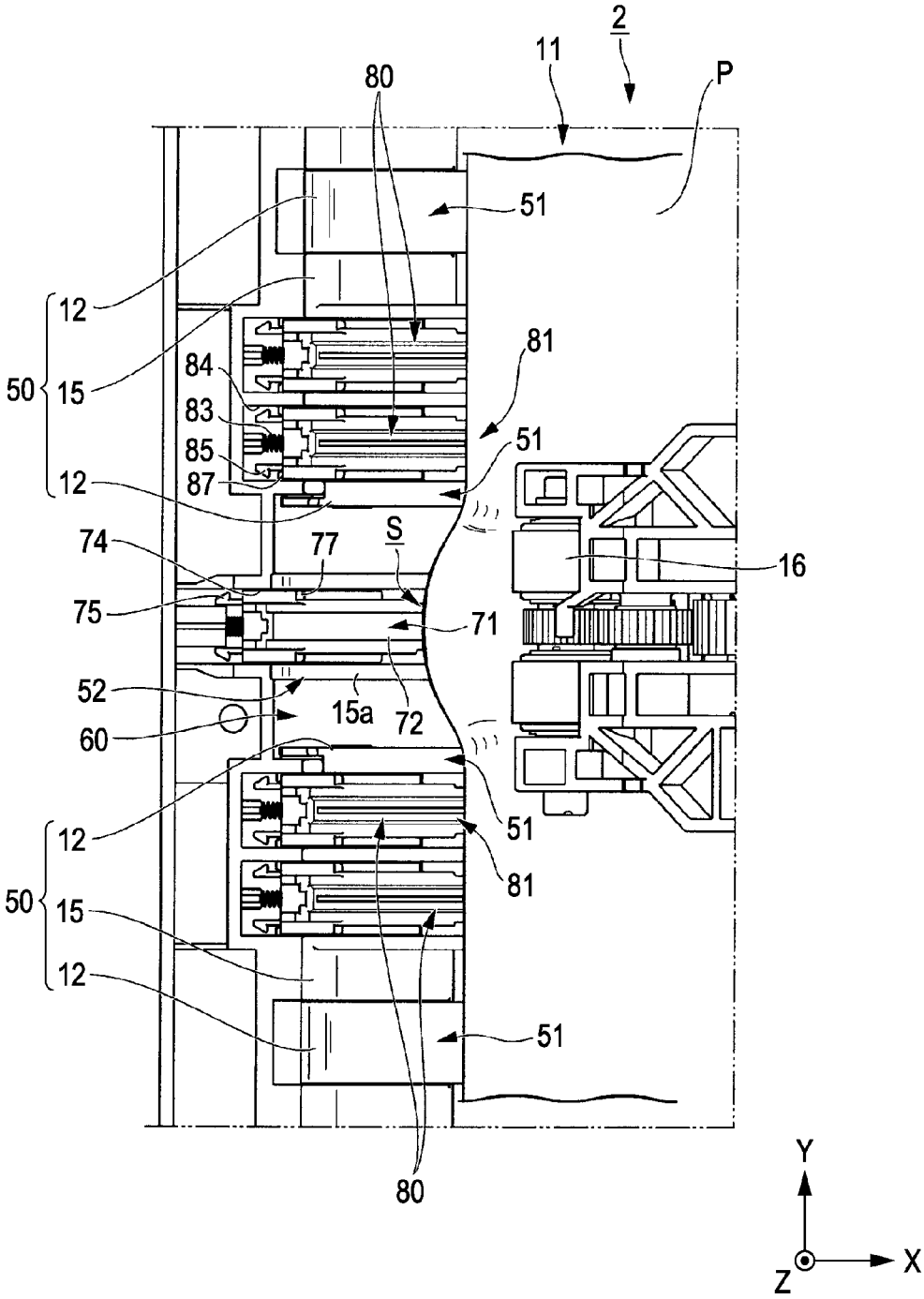
FIG. 13 is a drawing schematically showing a state in which the specific paper having high rigidity is fed to the separating bevel according to the third embodiment of the invention.

Referring now to FIG. 12 and FIG. 13, the action (operation) of the third separating bevels 80 having the configuration as described above will be described.

FIG. 12 is a drawing schematically showing a state in which the normal paper P1 having low rigidity is fed to the separating bevel 50 in the third embodiment of the invention. FIG. 13 is a drawing schematically showing a state in which the specific paper P2 having high rigidity is fed to the separating bevel 50 in the third embodiment of the invention.

As shown in FIG. 12, the normal paper P1 having low rigidity is fed by the rotation of the pickup roller 16 in the −X direction, the normal paper P1 comes into abutment with the second inclined planes 81 of third separating bevels 80 positioned on the nearside of the position of the inclined plane 51 of the separating bevel 50.

The third separating members 82 are urged in the +X direction by the spring members 83, and are set to provide urging forces to be larger than the load of the normal paper P1 at the corresponding point. Therefore, the third separating members 82 wait at the second position of separation without being pushed inward by the normal paper P1. The third separating members 82 positioned at the second position of separation come into abutment with the normal paper P1 at the second position of separation, and demonstrate a larger frictional force than that of the inclined plane 51 by the action of the abutment surfaces 81*a* and provides a load for separation. Therefore, lowering of the load can be compensated when a sufficient load cannot be obtained only with the inclined plane 51. Therefore, separation with high reliability which can further hardly cause the double feed is realized.

In contrast, as shown in FIG. 13, when the specific paper P2 having high rigidity is fed by the rotation of the pickup roller 16 in the −X direction, the specific paper P2 comes into abutment with the second inclined planes 81 of third separating bevels 80 positioned on the near side of the position of the inclined plane 51 of the separating bevel 50.

Since the third separating members 82 are urged by the spring member 83 in the +X direction, and are set to provide an urging force to be smaller than the load of the specific paper P2 at the corresponding point. Therefore, the third separating members 82 are pushed inward against the urging force by the specific paper P2 and are moved from the second position of separation to the third position of separation. The third separating members 82 positioned at the third position of separation are substantially flush with the inclined plane 51 of the bank portion 15, and at least parts of the abutment surfaces 81*a* are depressed in the −X direction with respect to the inclined plane 51, so that increase in load with respect to the specific paper P2 is restrained.

Subsequently, the specific paper P2 comes into abutment with the inclined plane 51 of the separating bevel 50 and the inclined plane 71 of the second separating bevel 70 which is substantially flush with the inclined plane 51 by the rotation of the pickup roller 16.

Since the second separating member 72 is urged by the sprig member 73 in the +X direction, and is set to provide an urging force to be smaller than the load of the specific paper P2 at the corresponding point. Therefore, the second separating member 72 is pushed inward against the urging force by the specific paper P2 and is moved from the position of separation to the space forming position. The second separating member 72 positioned at the space forming position is substantially flush with the inclined plane 52 of the second bank portion 15*a*, and forms the space S. When the space S is formed, the load of the specific paper P2 is lowered and hence the specific paper P2 can easily be deformed as described above, so that a reliable paper feeding with less probability of the non-feed phenomenon is realized.

When the abutment against the specific paper P2 is released, the second separating member 72 automatically moves from the space forming position to the position of separation to prepare for the next paper feeding at the position of separation, and the third separating members 82 move automatically from the third position of separation by the urging force of the spring member 73 to the second position of separation by the urging force of the spring member 83, and prepare for the next feeding at the second position of separation.

Therefore, according to the third embodiment described above, the third separating bevels 80 provided on parts of the inclined plane 51 except for the part where the space S is formed, and each having the second inclined plane 81 which demonstrates a higher frictional force than the inclined plane 51 are provided, and the third separating bevels 80 are provided so as to be movable between the second position of separation where the second inclined planes 81 are positioned on the upstream side of the inclined plane 51 in the feeding direction and the third position of separation where the inclined plane 51 and the second inclined planes 81 are substantially flush with each other. With this configuration, when the normal paper P1 having low rigidity is fed, the third separating bevels 80 are positioned at the second position of separation to come into abutment with the normal paper P1, thereby increasing the load (frictional force) and improve the separating performance. In contrast, when the specific paper P2 having high rigidity is fed, the third separating bevels 80 are positioned at the third position of separation, thereby restraining the increase of load which acts on the specific paper P2. Therefore, the load to be applied to the normal paper P1 having low rigidity is increased, so that reliable separation with less probability of the double feed is realized.

Although the preferable embodiments of the invention have been described with reference to the attached drawings, the invention is not limited to the embodiments described above. The shapes and the combinations of the respective components shown in the embodiments described above are examples only, and may be modified variously on the basis of design requirements without departing the scope of the invention.

For example, in the embodiments described above, the second separating bevels 70 and the third separating bevels 80 are moved by the urging force of the spring members. However, the invention is not limited thereto.

For example, a rubber member having the equivalent resilient force may be employed instead of the spring member. For example, the second separating bevel 70 and the third separating bevels 80 may be configured to be moved electrically using an actuator having a motor or the like.

In the description above, the angles of the abutment surfaces 81*a* of the second inclined planes 81 are set to be larger than the inclined plane 51 to increase the load. However, the load may be increased by providing separate members having a high coefficient of friction on the second inclined planes 81.

In the embodiments described above, a case where the recording apparatus is an ink jet printer has been described as an example. However, the recording apparatus is not limited to the ink jet printer, and may be apparatuses such as a copying machine or a facsimile.

What is claimed is:

1. A sheet material feeding device comprising:

a supporting unit that supports a plurality of sheet materials in a stacked manner;

a first separating bevel having an inclined plane inclined at a predetermined angle with respect to a supporting surface of the supporting unit and separating the sheet material coming into abutment with the inclined plane;

a pickup roller that feeds the sheet material toward the first separating bevel by coming into contact with the topmost sheet material from among the sheet materials supported by the supporting unit and being rotated thereon, wherein the pickup roller contacts with an area of the topmost sheet which is at predetermined distance from an edge of the topmost sheet, and wherein the pickup roller applies a load to the topmost sheet, and a second separating bevel which contacts with the topmost sheet fed by the pickup roller and which is movable by the topmost sheet fed by the pickup roller.

2. The sheet material feeding device according to claim 1, wherein the second separating bevel is movable between a move position which is moved relative to the inclined plane and a position of separation which forms a plane substantially flush with the inclined plane.

3. The sheet material feeding device according to claim 2, wherein the second separating bevel is positioned at the position of separation when a reaction force generated when the fed sheet material and the inclined plane come into abutment with each other is smaller than a predetermined value set on the basis of the rigidity of the sheet material, and is positioned at the move position when the reaction force is larger than the predetermined value.

4. The sheet material feeding device according to claim 2, comprising an urging device that urges the second separating bevel toward the position of separation, wherein the second separating bevel moves against the urging force from the position of separation to the move position.

5. The sheet material feeding device according to claim 1, comprising a third separating bevel provided on part of the inclined plane out of the first separating bevel and the second separating bevel in a perpendicular direction of the feeding direction and having a second inclined plane which demonstrates a higher frictional force than the inclined plane, wherein the third separating bevel is provided so as to be movable between a second position of separation where the second inclined plane is positioned on the upstream side of the inclined plane in the feeding direction and a third position of separation where the inclined plane and the second inclined plane are substantially flush with each other.

6. The sheet material feeding device according to claim 5, wherein the third separating bevel is positioned at the second position of separation when the reaction force generated when the fed sheet material and the inclined plane come into abutment with each other is smaller than a predetermined value set on the basis of the rigidity of the sheet material, and is positioned at the third position of separation when the reaction force is larger than the predetermined value.

7. The sheet material feeding device according to claim 5, comprising a second urging device that urges the third separating bevel toward the second position of separation, wherein the third separating bevel moves against the urging force from the second position of separation to the third position of separation.

8. The sheet material feeding device according to claim 5, wherein an abutment surface of the second inclined plane which comes into abutment with the sheet material when being fed is formed to have a larger angle than a predetermined angle of the inclined plane.

9. A recording apparatus comprising the sheet material feeding device according to claim 1 and a recording unit that performs a recording process on the sheet material fed by the sheet material feeding device.

* * * * *